US005749271A

United States Patent [19]

Liu

[11] Patent Number: 5,749,271

[45] Date of Patent: May 12, 1998

[54] DUAL PURPOSE RATCHET SCREWDRIVER

[76] Inventor: Tasi-Fa Liu, 2F, No.3-1, Alley 15, Lane Shui Ching.Peitun District 406, Taichung City, Taiwan

[21] Appl. No.: 668,699

[22] Filed: Jun. 24, 1996

[51] Int. Cl.[6] ..... B25B 13/46

[52] U.S. Cl. ..... 81/60; 81/490; 81/438; 81/63

[58] Field of Search ..... 81/60, 61, 62, 81/63, 63.1, 63.2, 438, 439, 490

[56] References Cited

U.S. PATENT DOCUMENTS

| | | | |
|---|---|---|---|
| 3,114,401 | 12/1963 | Johnson | 81/438 |
| 3,824,881 | 7/1974 | Wright | 81/63 |
| 4,448,097 | 5/1984 | Rocca | 81/62 |
| 4,466,523 | 8/1984 | De Carolis et al. | 81/62 |
| 4,621,718 | 11/1986 | DeCarolis | 81/63.1 |
| 4,762,032 | 8/1988 | Chow | 81/62 |
| 5,142,953 | 9/1992 | Lin | 81/63.2 |
| 5,339,711 | 8/1994 | Shu | 81/63 |
| 5,533,429 | 7/1996 | Kozak | 81/438 |

FOREIGN PATENT DOCUMENTS

| | | | |
|---|---|---|---|
| 0312775 | 4/1989 | European Pat. Off. | 81/490 |
| 705087 | 6/1931 | France | 81/63.1 |
| 3004958 | 8/1981 | Germany | 81/439 |

*Primary Examiner*—Eileen Morgan
*Assistant Examiner*—Joni B. Danganan
*Attorney, Agent, or Firm*—Bacon & Thomas

[57] ABSTRACT

A ratchet screwdriver includes a handle having a chamber in its interior for accommodating a ratchet mechanism, a drive sleeve of the ratchet mechanism being provided to cooperate with a transmission shaft inserted through a hole of the handle, the transmission shaft having a bit at either end, the bit at one end of the transmission shaft being utilized as a structural element for power transmission while the bit at the other end being used to drive a screw. The ratchet mechanism may be enveloped by a bit receptacle made of plastics before the mechanism is put inside the chamber such that the drive sleeve is fitted with the transmission shaft fixedly located at the front end of the handle. A rear cap may be provided at the rear end of the handle.

2 Claims, 8 Drawing Sheets

DUAL PURPOSE RATCHET SCREWDRIVER

BACKGROUND OF THE INVENTION (a). Field of the Invention

The present invention relates generally to a screwdriver, and more particularly to a ratchet screwdriver having a chamber for accommodating multiple bits and a ratchet mechanism while being dust proof, oil stain proof and electrically insulating.

(b). Description of the Prior Art

Conventional drivers are generally configured to have a cabinet/keystone tip or a Phillips head tip of a unitary size. Hence, in use, it is necessary to select the type of screwdriver suitable for use in driving screws of different sizes. Aiming to improve on the unitary function and practicality of conventional drivers, manufacturers have developed new kinds of screwdriver structure. Referring to FIG. 1 which shows a screwdriver 10 having a compartment 11. The screwdriver 10 includes 1 handle 12 having a shank 13 fixedly provided at its front end. The handle 12 has an interior fitted with a pull handle 15 having the compartment 11 containing a plurality of bits 14. The compartment 11 of the pull handle 15 is provided for keeping a plurality of bits 14 of various specifications and sizes. The user may pick out a suitable bit 14 and insert it into a receiving hole at a front end of the shank 13. Thus, the screwdriver may be used for driving screws of various sizes and specifications.

With reference to FIG. 2, which shows a ratchet screwdriver 20. The ratchet screwdriver 20 includes a handle 21, a spindle 22 and a ratchet mechanism 23 disposed between the handle 21 and the spindle 22. By shifting a ratchet shifter 24 and turning the handle 21, the spindle 22 and a bit 25 may turn in a set direction.

Although these new screwdriver structures can achieve their respective intended purposes, they have some drawbacks. Although the screwdriver 10 is provided with a plurality of bits 14 to improve its practicality, it is not as efficient as the ratchet screwdriver 20. Relatively speaking, although the ratchet screwdriver 20 facilitates the driving operating, it is not equipped with bits of various sizes. Besides, the ratchet mechanism 23 thereof is exposed on the surface of the screwdriver 20 and may easily get dusty or stained, affecting its life. On the other hand, if the screwdriver 20 is used to drive screws of an electrical appliance which does not have any grounding or the work site generates relatively great static electricity and if the ratchet shifter is accidentally shifted when the screwdriver 20 is already in contact with the screws, electric shock might occur.

Furthermore, the compartment 11 of the screwdriver 10 is generally injection molded from plastic materials and each of the insert portions 18 thereof is constituted by two plates 17 suitably spaced apart from each other. As plastic materials tend to become hardened and transfigured due to climatic conditions or frequent rubbing, the insert portions 18 of the compartment 11 may become distorted in shape and fail to grip the bits 14 firmly. As a result, when the user pulls out the pull handle 15, the bits in the compartment 11 may fall and scatter on the floor.

SUMMARY OF THE INVENTION

Accordingly, a primary object of the present invention is to provide a multiple purpose ratchet screwdriver to eliminate the drawbacks with the prior art.

In order to achieve the above-mentioned object, the ratchet screwdriver of the present invention essentially comprises a handle having a chamber in its interior for accommodating a ratchet mechanism, a drive sleeve of the ratchet mechanism being provided to cooperate with a transmission shaft inserted through a hole of the handle, the transmission shaft having a bit at either end, the bit at one end with of the transmission shaft being utilized as a structural element for power transmission while the bit at the other end being used to drive a screw. The ratchet mechanism may be enveloped by a bit receptacle made of plastic before the mechanism is put inside the chamber such that the drive sleeve is fitted with the transmission shaft fixed located at the front end of the handle. A rear cap may be provided at the rear end of the handle.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
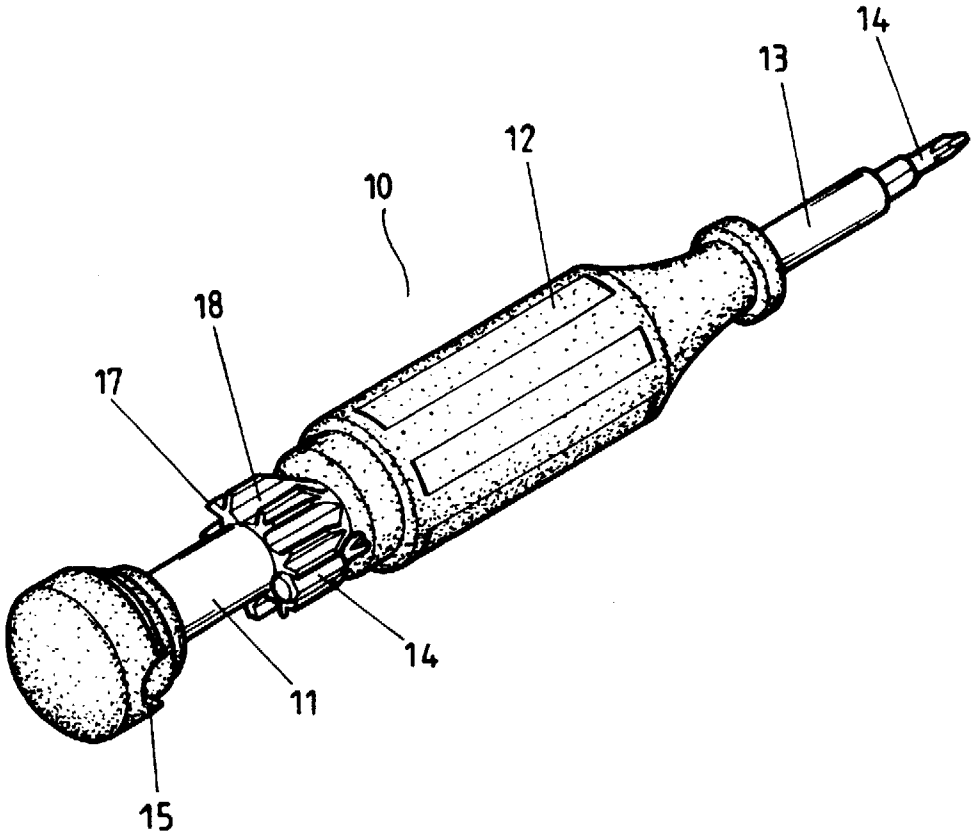
FIG. 1 PRIOR ART
FIG. 1 is an elevational view of a prior screwdriver with a compartment for accommodating bits.
Figure 2:
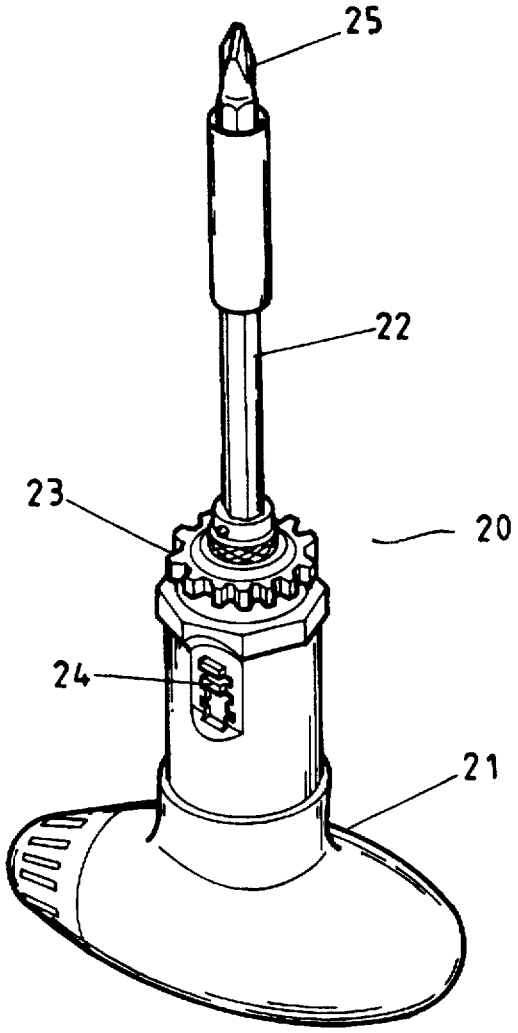
FIG.2 PRIOR ART
FIG. 2 is an elevational view of a prior ratchet screwdriver.
Figure 3:
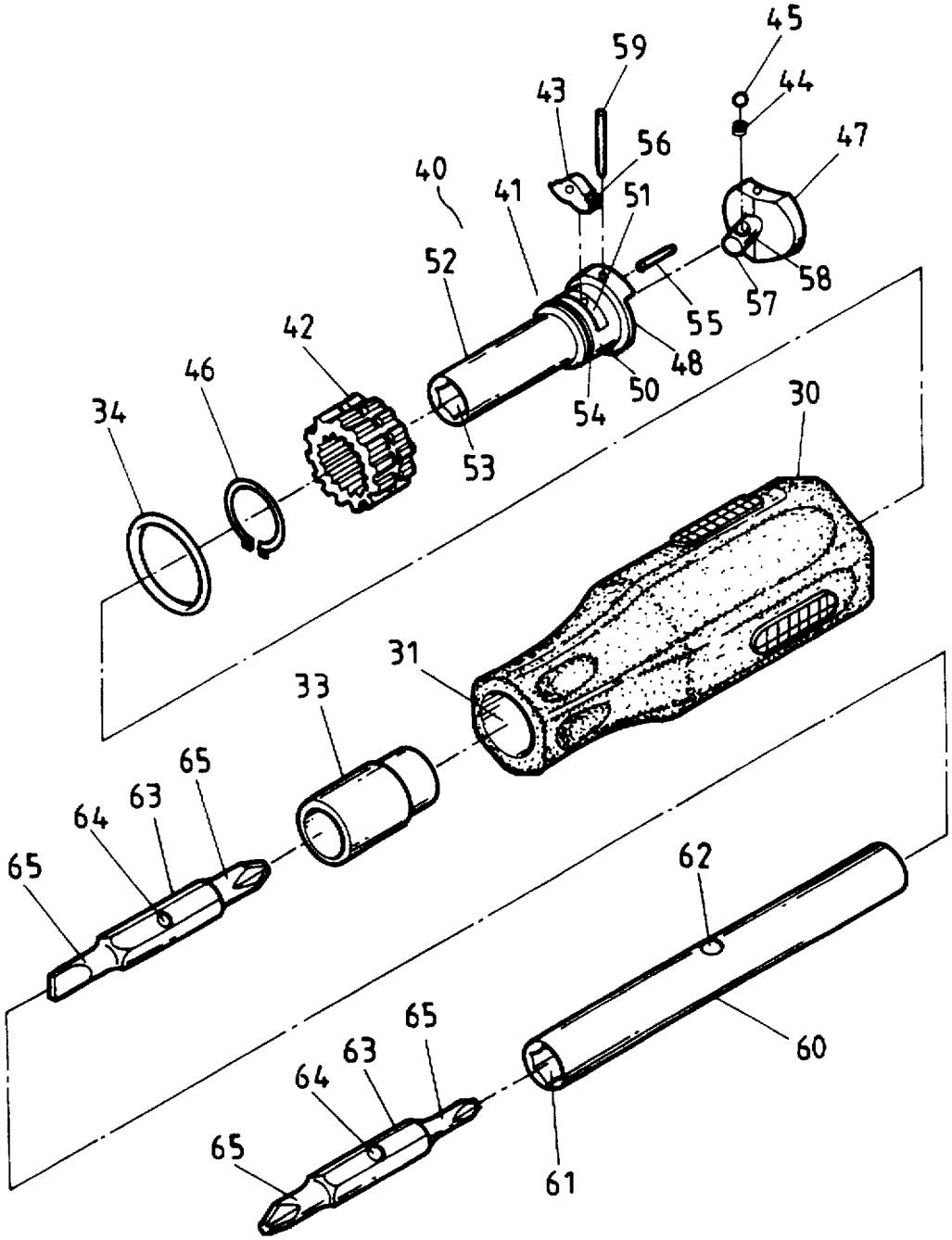
FIG. 3 is an exploded elevational view of a first preferred embodiment of the ratchet screwdriver of the invention.
Figure 4:
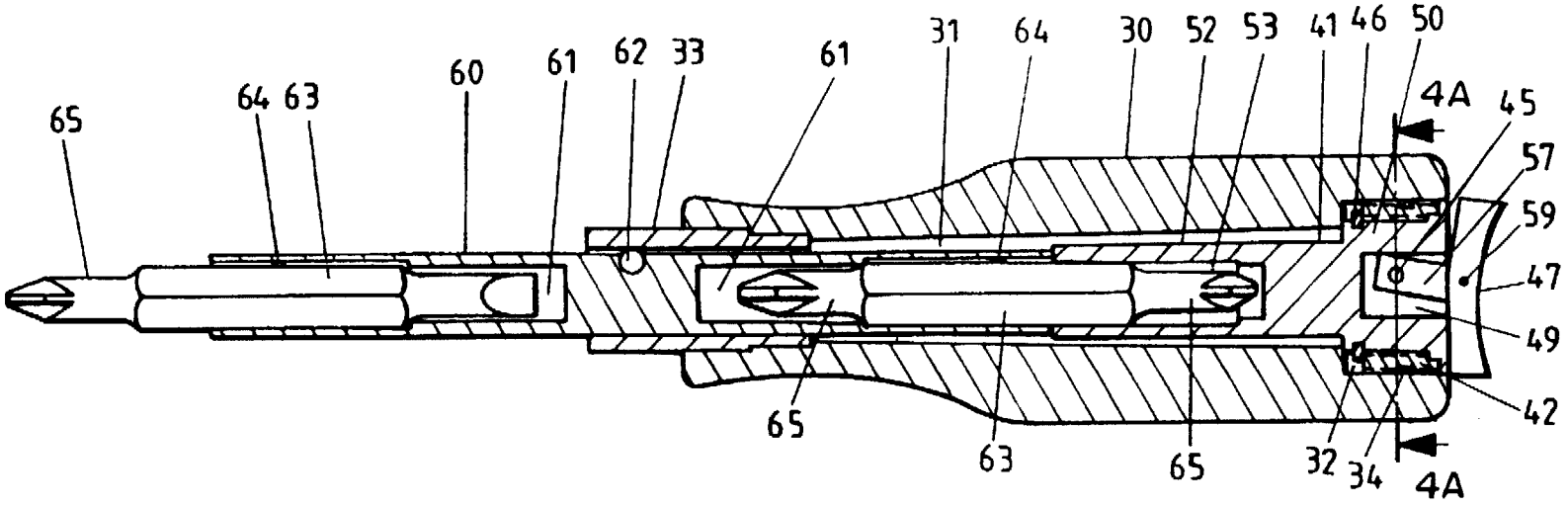
FIG. 4 is a sectional view of the first preferred embodiment the ratchet screwdriver of the invention in an assembled state.
Figure 4A:
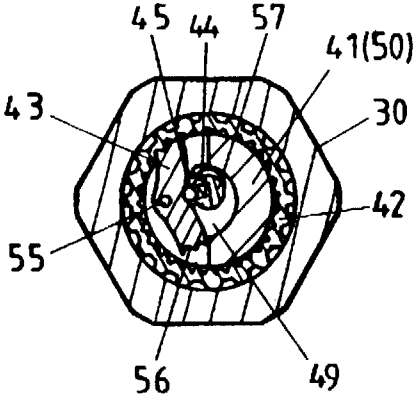
FIG. 4A is a cross-sectional view taken along line A—A of FIG. 4.

With reference to FIGS. 3, 4 and 4A, first preferred embodiment of the present invention essentially comprises a handle 30, a ratchet mechanism 40 and a transmission shaft 60.

The handle 30 has a through hole 31 extending axially through an interior thereof, a compartment 32 being arranged at one end of the through hole 31 and a positioning ring 33 being disposed at the other end thereof.

The ratchet mechanism 40 includes a body 41, a ratchet ring 42, a stop piece 43, a spring 44, an urge ball 45, a split ring 46 and a push button 47. After assembly, the ratchet mechanism 40 is forcefully squeezed into the compartment 32 of the handle 30. The body 41 has one end provided with a support portion 48 having an elongated groove 49 at a surface thereof for associating the support portion 48 with an elongated notch 51 of a link section 50 of the body 41. The body 41 has the other end provided with a drive sleeve 52 having one end provided with a polygonal insert hole 53.

The ratchet ring 42 is fitted onto the link section 50 of the body 41 and is provided with ratchet teeth both internally and externally. The split ring 46 is fitted onto an insert groove 54 of the link section 50 for positioning purposes. The stop piece 43 is pivotally disposed in the notch 51 of the link section 50 by means of a pin 55. The stop piece 43 is further configured to have a slanting ratchet portion 56 at either lateral side for engaging the internal ratchet teeth of the ratchet ring 42. The push button 47 is configured to have a curved head portion and is pivotally disposed on the support portion 48 of the body 41 by means of another pin 59. An extension rod 57 extends substantially perpendicularly to the push button 47. A slot 58 is formed at a suitable position of the extension rod 57 for receiving in turn the spring 44 and the urge ball 45. At this point, the urge ball 45 is urging against an inner surface of the stop piece 43.

When the push button 47 is pressed, the extension rod 57 will slant and urge against the opposing side of the stop piece 43, thereby controlling the direction of engagement of the lateral ratchet portions 56 of the stop piece 43 and the ratchet ring 42, thus accomplishing the purpose of unidirectionally driving the screwdriver of the invention.

The transmission shaft 60 is substantially cylindrical with a polygonal insert hole 61 at either end. A retaining ball 62 is insertably provided at a middle portion of the transmission shaft 60. Two bits 63 are respectively inserted into the insert holes 61 at the ends of the transmission shaft 60. Each bit 63 is configured to have two tips 65 of different specifications and shapes and a stem of a polygonal shape with a retaining ball 64 insertably provided therein. The transmission shaft 60 is fitted into the through hole 31 of the handle 30.

Additionally, an urging ring 34 is fitted into an annular groove of the ratchet ring 42 for keeping the ratchet ring 42 tightly against the compartment 32 of the handle 30.

In an operation to drive a screw, the transmission shaft 60 is pulled out of the through hole 31 of the handle 30 and the bit 63 with the suitable tip 65 is selected. The transmission shaft 60 is then fitted into the through hole 31 of the handle 30 again. With reference to FIG. 4, at this point, the bit 63 with the selected tip 65 protrudes from one end of the transmission shaft 60 and is exposed on the outside while another bit 63 at the other end of the transmission shaft 60 is fitted into the insert hole 53 of the drive sleeve 52 of the body 41 of the ratchet mechanism 40. Then, the push button 47 may be pressed as determined by the rotational direction desired. When the bit 63 is to be changed, it is only necessary to pull out the transmission shaft 60 again and take out another bit 63.

Figure 5:
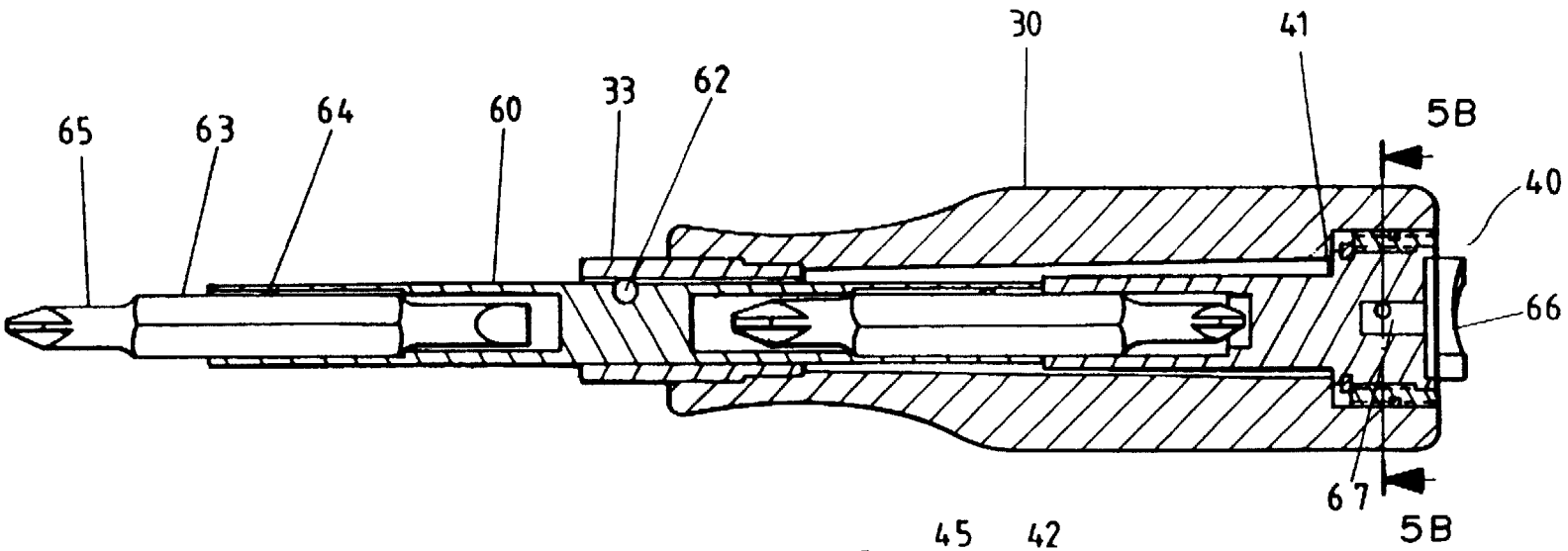
FIG. 5 is a sectional view of a second preferred embodiment of the ratchet screwdriver of the invention in an assembled state.
Figure 5B:
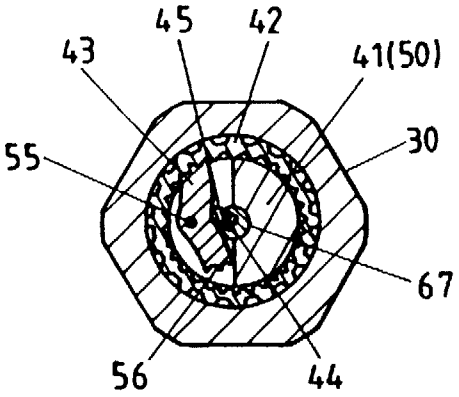
FIG. 5A a cross-sectional view taken along line B—B of FIG. 5.

FIGS. 5 and 5B show second preferred embodiment of the present invention. In this preferred embodiment, the push button 47 is substituted by a shifter 66 having an extension rod 67 which may turn on the same spot to achieve similar effects.

Figure 6:
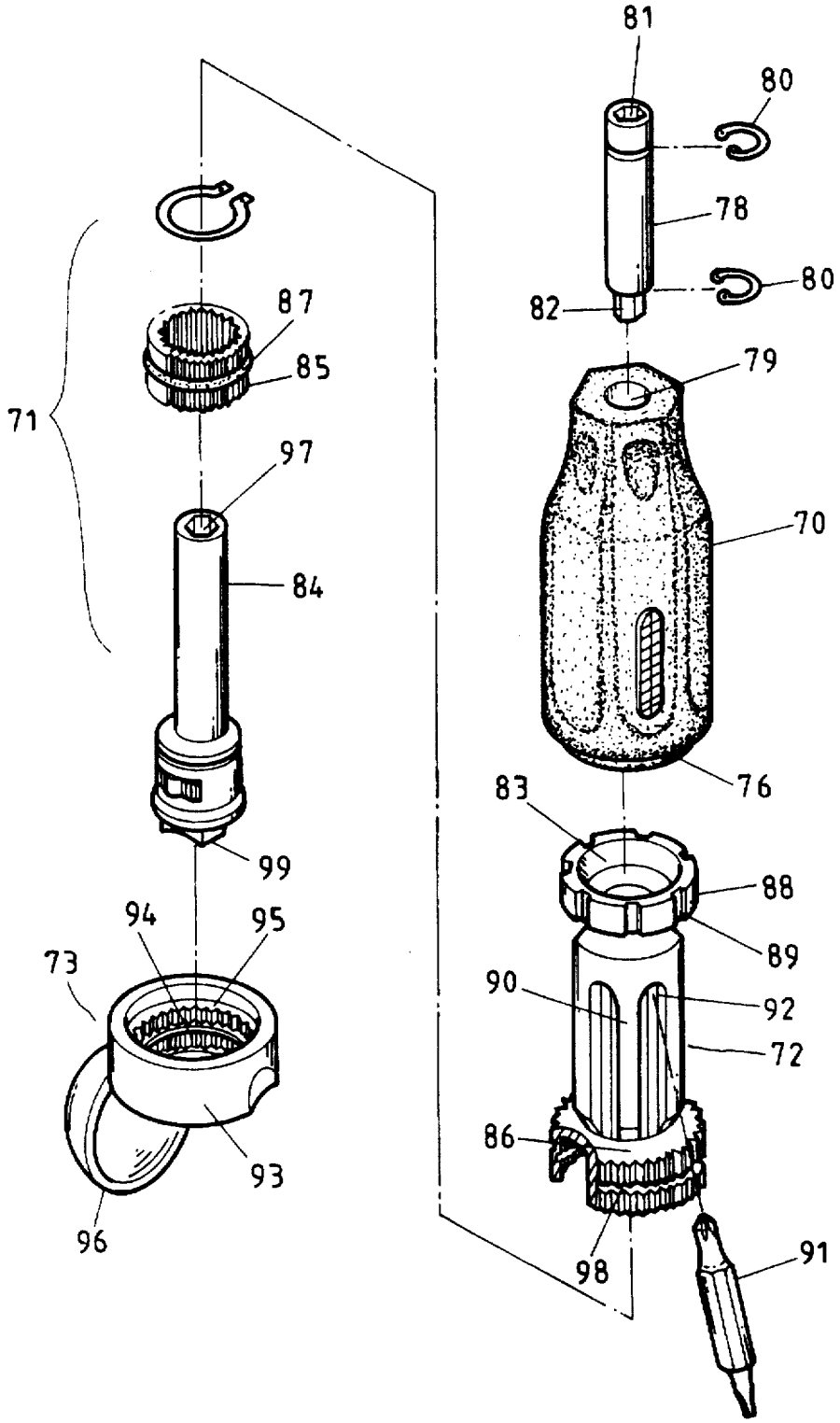
FIG. 6 is an exploded elevational view of a third preferred embodiment of the ratchet screwdriver of the invention.
Figure 7:
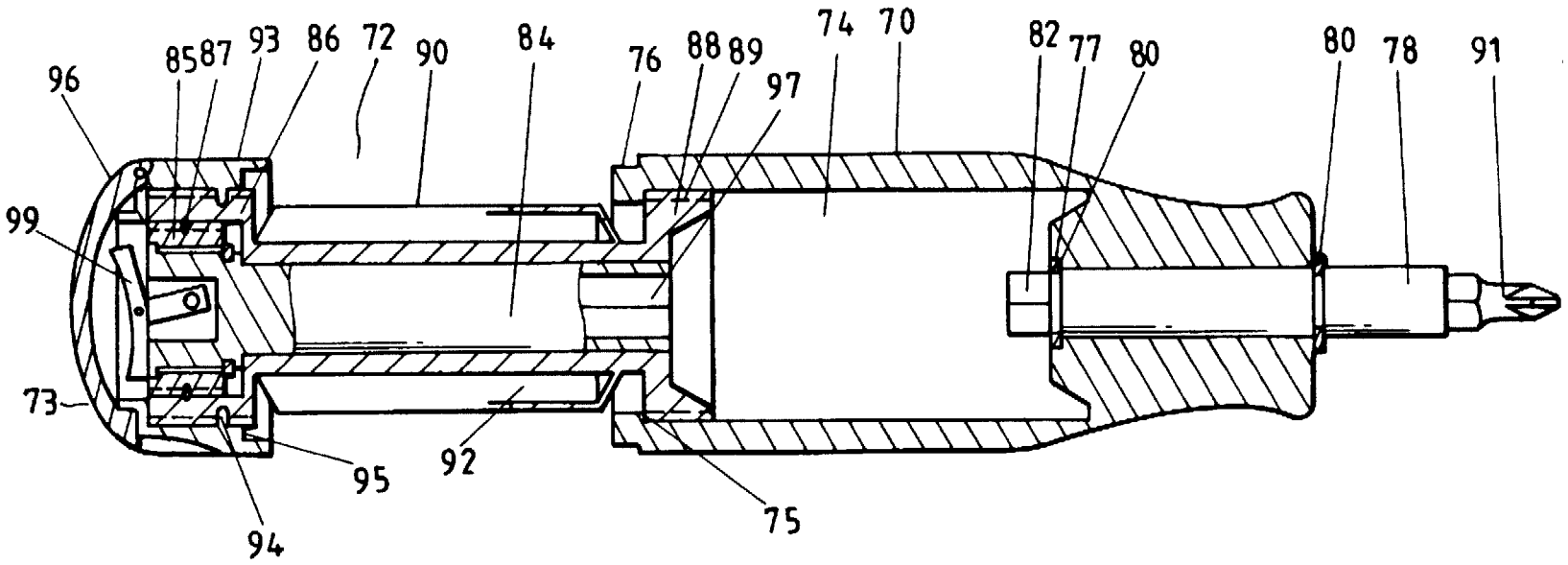
FIG. 7 is a sectional view of the third preferred embodiment of the ratchet screwdriver of the invention in an assembled state.

Reference is further made to FIGS. 6 and 7, which illustrate a third preferred embodiment of the present invention. This preferred embodiment essentially comprises a handle 70, a ratchet mechanism 71, a bit locking means 72 and a rear cap 73.

The handle 70 is configured to have a chamber 74 of a predetermined depth extending inwardly from a rear end of the handle 70. The outer and inner sides of a rear edge of the chamber 74 are respectively provided with a stop block 75 and an engaging edge 76. The inner wall of a front end of the chamber 74 is annularly provided with an insert groove 77, and a guide hole 79 is provided to extend from a middle section portion of the chamber 74 through to a front end of the handle 70 for receiving a shaft 78. The shaft 78 has its ends each respectively positioned by a C-clip 80 and is rotatable. The shaft is further provided with a receiving hole 81 at its front end and a polygonal post 82 at its rear end for projecting into the rear end of the chamber 74.

Figure 8:
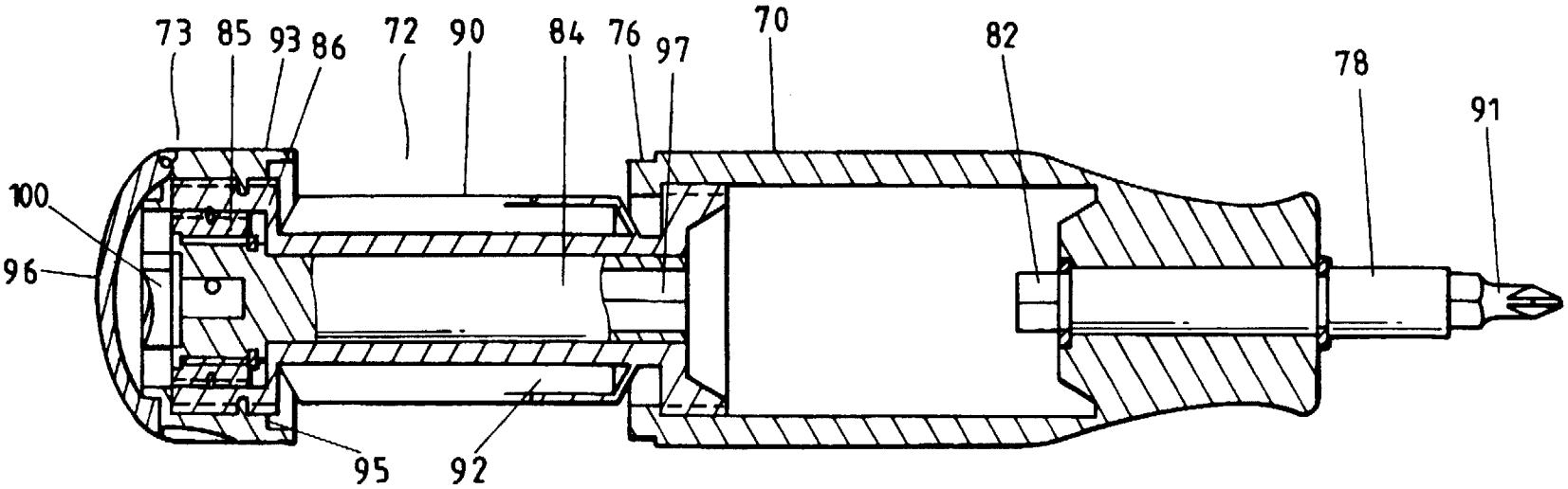
FIG. 8 is a sectional view of the fourth preferred embodiment of the ratchet screwdriver of the invention in an assembled state.

The ratchet mechanism 71 in this preferred embodiment is identical with the ratchet mechanism 40 in the first preferred embodiment; therefore, it will not be discussed in detail herein. It should however be noted that whether a push button 99 or a shifter 100, as shown in FIG. 8, of the ratchet mechanism 71 is adopted, it is made of nonelectrically conductive materials.

The bit locking means 72 is injection molded from plastic materials and is inserted into the chamber 74 of the handle 70. The bit locking means 72 has a central through hole 83 communicating both of its ends. A drive sleeve 84 of the ratchet mechanism 71 may be disposed in the through hole 83. A rear end of the bit locking means 72 is enlarged to form a support portion 86 for accommodating the ratchet mechanism 71. The support portion 86 is internally and externally provided with toothed surfaces; the toothed surface on the inner wall of the support portion engages a ratchet ring 85 of the ratchet mechanism 71. And by means of a positioning ring 87 disposed at a middle section of the ratchet ring 85, the support portion 86 and the ratchet ring 85 can be firmly positioned. An annular seat 88 is further provided at the front end of the bit locking means 72. The annular seat 88 is externally and circumferentially provided with a plurality of recesses 89 so that, when the bit locking means 72 is to be mounted in the chamber 74 of the handle 70, the recesses 89 of the annular seat 88 must align with the stop block 75 at the inner wall of the chamber 74 before the bit locking means 72 may be guided and inserted into the chamber 74. Furthermore, the space between the support portion 86 and the annular seat 88 is divided into a plurality of compartments 92 by means of a plurality of partition plates 90 for accommodating a plurality of bits 91.

The rear cap 73 is disposed at the rear end of the handle 70 and has a hollow cap body 93 for receiving the support portion 86. The cap body 93 is internally and circumferentially provided with a toothed surface matching that on the outside of the support portion 86. The toothed surface of the cap body 93 is further provided with a raised ring 94 at a middle section thereof. An inner wall of the cap body 93 near its top end is peripherally provided with a shallow terrace 95 for fitting with the engaging edge 76 of the handle 70.

The rear cap 73 is additionally provided with a curved cap element 96 at a bottom side of the cap body 93. The curved cap element 96 is provided with a non-skid surface to facilitate turning.

Assembly of the third preferred embodiment of the ratchet screwdriver of the invention will be described below.

The ratchet mechanism 71 is first disposed in the bit locking means 72 so that the drive sleeve 84 passes through the through hole 83 of the bit locking means 72, while the ratchet ring 85 engages the inner toothed surface of the support portion 86 and is positioned by the positioning ring 87. Then the assembled part is fitted into the chamber 74 of the handle 70. In other words, the recesses 89 of the annular seat 88 of the bit locking means 72 are caused to align with the stop block 75 of the chamber 74 before the bit locking means 72 is inserted into the chamber 74. The drive sleeve 84 is then caused to have an insert hole 97 at its rear end to fit with the polygonal post 82 of the shaft 78. Finally, the rear cap 73 is fitted onto the support portion 86 such that the raised ring 94 just fits into an insert groove 98 of the support portion 86.

In use, the bit 91 with a suitable specification and size may be selected. It is only necessary to apply a little force to cause the rear cap 73 to become separated from the handle 70 (i.e., disengaging them at the engaging edge 76 of the handle 70 and the shallow terrace 95 of the rear cap 73). Then the rear cap 73, the ratchet mechanism 71 and the bit locking means 72 are all pulled rearwardly so that the annular seat 88 is retained by the stop block 75 of the chamber 74, preventing the ratchet mechanism 71 from falling out. At this point, the user may pick out a suitable bit 91 from the compartments 92 and fit into the receiving hole 81 of the shaft 78. On the other hand, the curved cap element 96 may be opened, and by pressing the push button 99 and turning the handle 70, the drive sleeve 84 may be driven to bring the shaft 78 and the bit 91 to turn in a set direction.

Furthermore, the rear end of the shaft 78 may be configured to be a socket. Relatively, the front end of the drive sleeve 84 has to be configured to be a polygonal post.

Reference is now made to FIG. 8 which shows a fourth preferred embodiment of the present invention. The push button 99 is modified to be the shifter 100.

Obviously, the first and second preferred embodiments of the ratchet screwdriver of the invention may be modified to include a rear cap, and the third and fourth preferred embodiments may do without the rear cap.

Although the present invention has been illustrated and described with reference to the preferred embodiment thereof, it should be understood that it is in no way limited to the details of such embodiment but is capable of numerous modifications within the scope of the appended claims.

What is claimed is:

1. A dual purpose ratchet screwdriver of the type comprising a handle, a ratchet mechanism, a bit locking means and a rear cap, wherein said handle has a chamber of a predetermined depth formed at a rear end thereof and extending inwardly, said chamber being provided with a stop block and an engaging edge at the respective inner and outer sides of a rear portion thereof, said chamber further having an insert groove at an inner wall of a front portion thereof, a guide hole being provided to extend from a middle portion of said chamber to a front end of said handle for insertion of a shaft; said shaft being turnable and positioned at its respective ends by a C-clip, said shaft being provided with a receiving hole at the front end thereof and a polygonal post at the rear end thereof for extending into the rear end of said chamber;

said bit locking means is injection molded from plastic materials and is inserted into said chamber of said handle, said bit locking means having a through hole connecting its ends for receiving a drive sleeve of said ratchet mechanism, a rear end of said bit locking means being enlarged to form a support portion for accommodating said ratchet mechanism, said support portion being internally and externally provided with a toothed surface, said toothed surface on the inner wall of said support portion matching a ratchet ring of said ratchet mechanism, and a positioning ring at a middle section of said ratchet ring being used to position said support portion and said ratchet ring, said bit locking means further having an annular seat at a front end thereof, said annular seat being externally and circumferentially provided with a plurality of recesses which should align with said stop block of said chamber to permit insertion of said bit locking means into said chamber; the part of said bit locking means between said annular seat and said support portion being divided into a plurality of compartments by means of a plurality of partition plates for accommodating a plurality of bits of different specifications and sizes;

said rear cap is fitted onto said rear end of said handle and has a hollow cap body for receiving said support portion of said bit locking means, said cap body having an inner wall provided with a toothed surface for matching the toothed surface formed externally on said support portion, said toothed surface of said cap body having a raised ring at a middle portion thereof, and a shallow terrace being formed at the inner wall of said cap body near its front end for matching said engaging edge of said chamber, and a non-skid curved cap element being provided at a bottom side of said cap body for facilitating turning.

2. The dual purpose ratchet screwdriver as claimed in claim 1, wherein said drive sleeve is configured to have socket at a front end thereof.

* * * * *